US009276354B2

(12) United States Patent
Kraus

(10) Patent No.: US 9,276,354 B2
(45) Date of Patent: Mar. 1, 2016

(54) PLUG FOR A DATA CABLE WITH PULLING PRESSURE RELEASE

(71) Applicant: Zellner GmbH, Teisnach (DE)

(72) Inventor: Josef Kraus, Viechtach (DE)

(73) Assignee: Zellner GmbH, Teisnach (DE)

( * ) Notice: Subject to any disclaimer, the term of this patent is extended or adjusted under 35 U.S.C. 154(b) by 0 days.

(21) Appl. No.: 14/369,751

(22) PCT Filed: Jan. 2, 2013

(86) PCT No.: PCT/IB2013/050032

§ 371 (c)(1),
(2) Date: Jun. 30, 2014

(87) PCT Pub. No.: WO2013/098801

PCT Pub. Date: Jul. 4, 2013

(65) Prior Publication Data

US 2014/0364001 A1 Dec. 11, 2014

(30) Foreign Application Priority Data

Dec. 31, 2011 (DE) ..... 20 2011 052 551

(51) Int. Cl.
*H01R 13/627* (2006.01)
*H01R 13/633* (2006.01)
*H01R 24/64* (2011.01)

(52) U.S. Cl.
CPC ..... *H01R 13/6275* (2013.01); *H01R 13/6272* (2013.01); *H01R 13/633* (2013.01); *H01R 24/64* (2013.01)

(58) Field of Classification Search
CPC ..... H01R 13/6275; H01R 13/6272; H01R 13/633; H01R 13/627; H01R 24/64
USPC ..... 439/352–358, 449, 942, 344, 345; 29/428
See application file for complete search history.

(56) References Cited

U.S. PATENT DOCUMENTS 4,603,936 A * 8/1986 Jagen ..... 439/354
5,462,457 A 10/1995 Schroepfer et al.
5,545,052 A * 8/1996 Hirai ..... 439/354
(Continued)

FOREIGN PATENT DOCUMENTS

DE 199 53 494 C1 7/2001
DE 20 2004 019 870 U1 3/2005
(Continued)

*Primary Examiner* — Javaid Nasri
(74) *Attorney, Agent, or Firm* — Roberts Mlotkowski Safran & Cole, PC; David S. Safran

(57) ABSTRACT

A plug for a data cable, has a conventional front plug element with a latching tongue, a plug element with a front sub-body which is attached to the plug element at the front end of the data cable in a tension-resistant manner to provide a high tensile strength, a rear sub-body, a forward-facing latching tongue protection element and a flexible kink protection element. An angularly curved actuating lever pushes onto the latching tongue and is guided at the other end inside an actuating lever guide, wherein, the plug is connected, an actuation side of the actuating lever lies on a front area of the latching tongue protection element, and wherein, pulling out at an area of the rear sub-body, the actuating lever is actuated, creating pressure on the latching tongue and releasing the lock connection, so that the data cable plug can be pulled out in an unlocked state.

12 Claims, 10 Drawing Sheets

(56) References Cited

U.S. PATENT DOCUMENTS

| | | | |
|---|---|---|---|
| 5,620,335 | A | 4/1997 | Siemon |
| 5,620,335 | C1 | 2/2001 | Siemon |
| 7,063,554 | B2 | 6/2006 | Kuiken et al. |
| 8,152,384 | B2 | 4/2012 | de Jong et al. |
| 8,391,667 | B2 | 3/2013 | Teo et al. |
| 2004/0247252 | A1 | 12/2004 | Ehrenreich et al. |
| 2011/0080008 | A1 | 4/2011 | Teo et al. |
| 2011/0091159 | A1 | 4/2011 | de Jong et al. |

FOREIGN PATENT DOCUMENTS

| | | | |
|---|---|---|---|
| DE | 10 2006 035 724 | B4 | 10/2009 |
| DE | 20 2011 052 551 | U1 | 7/2012 |
| EP | 1 653 566 | A1 | 5/2006 |
| EP | 2 284 964 | A1 | 2/2011 |
| WO | 2009/135787 | A1 | 11/2009 |

* cited by examiner

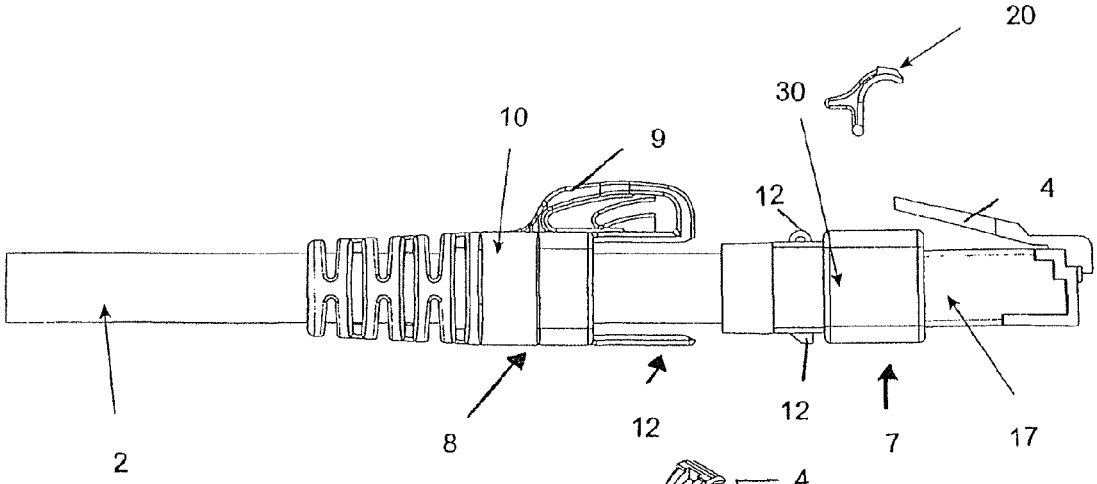
FIG. 1a
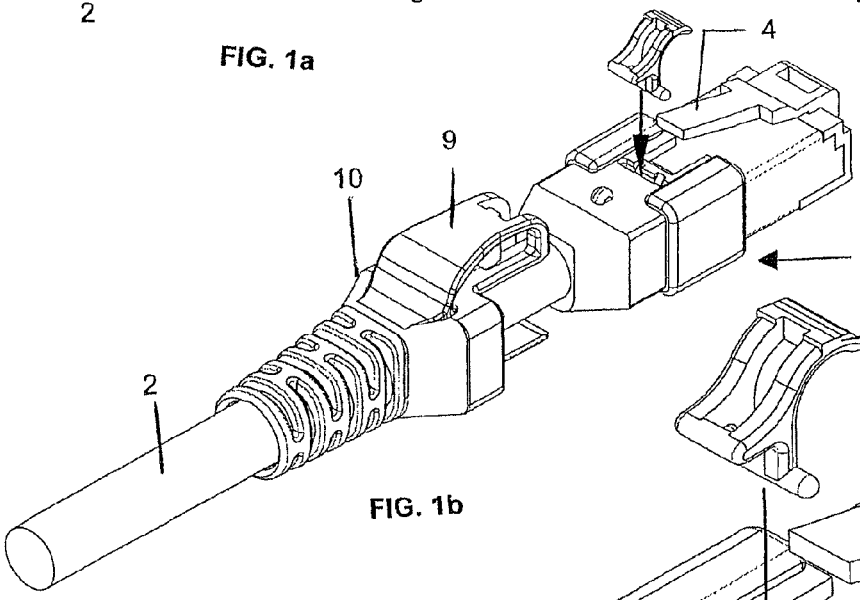
FIG. 1b
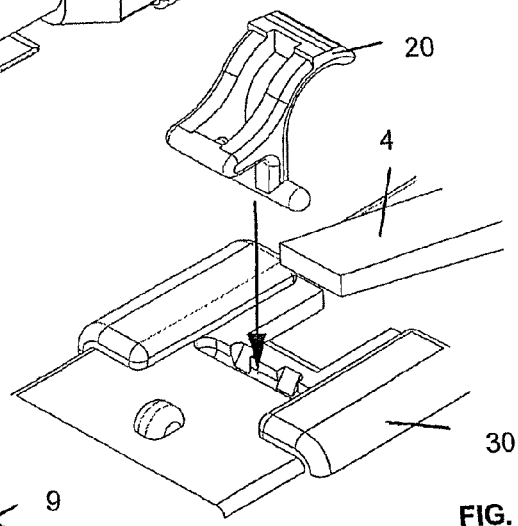
FIG. 1c
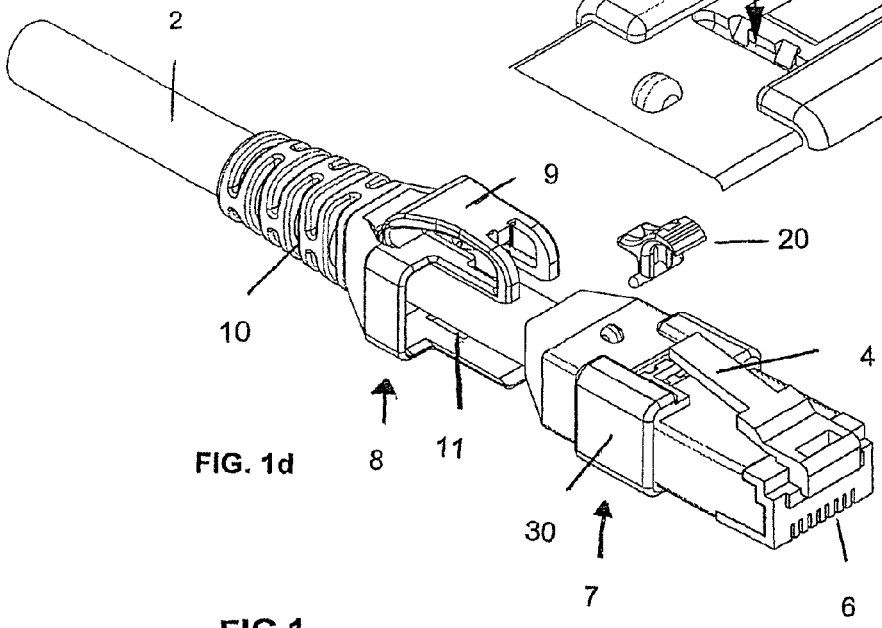
FIG. 1d
FIG.1

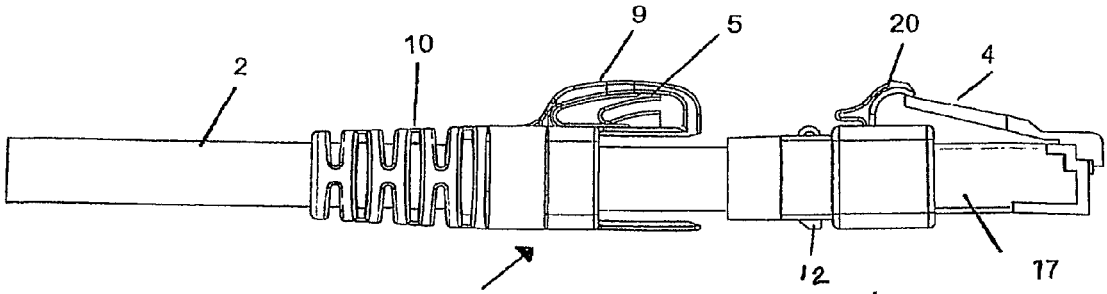
FIG. 2a
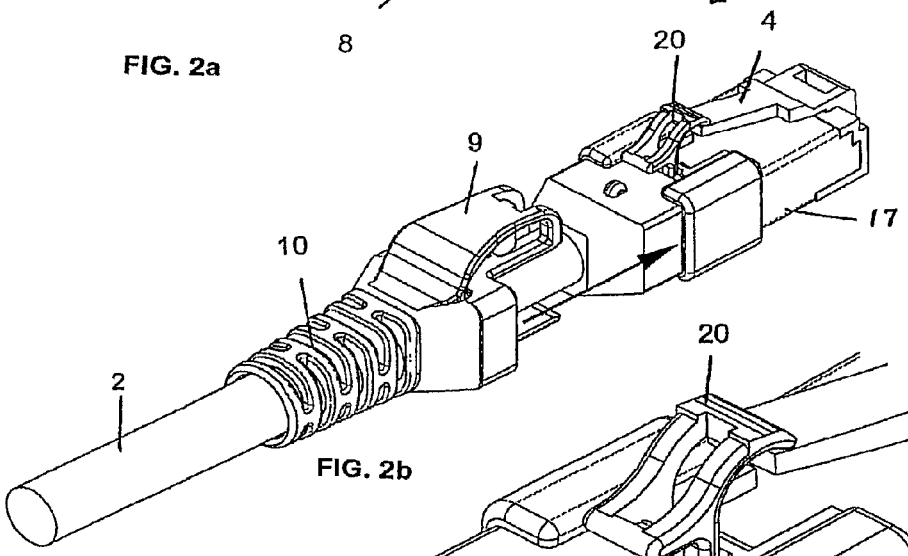
FIG. 2b
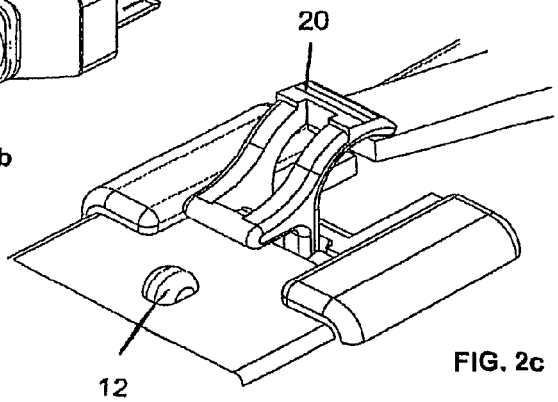
FIG. 2c
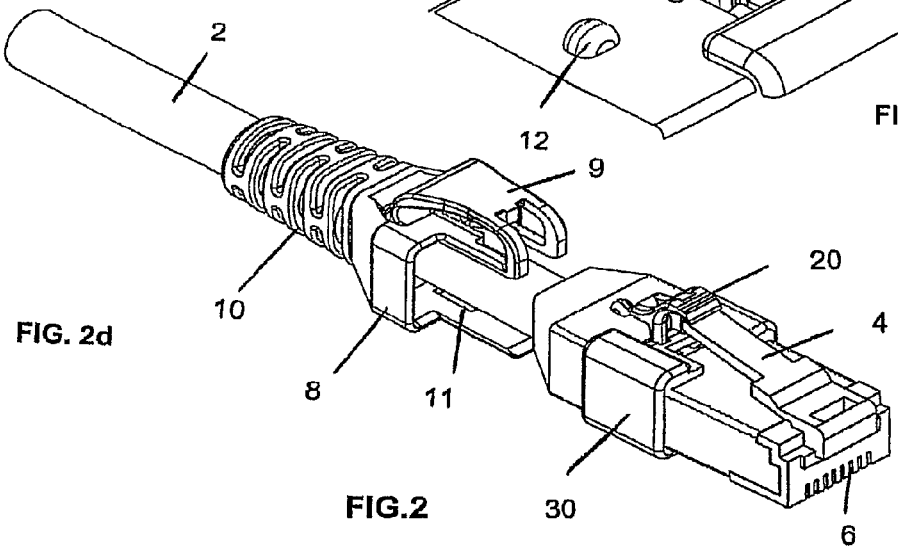
FIG. 2d
FIG.2

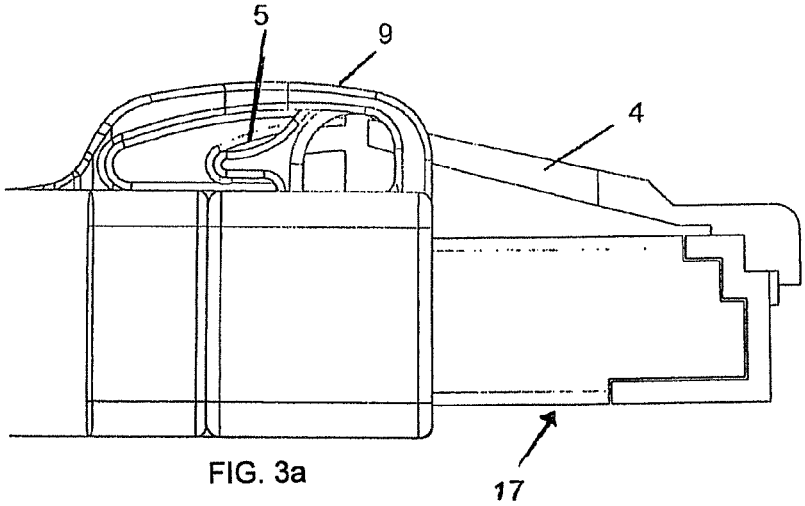
FIG. 3a
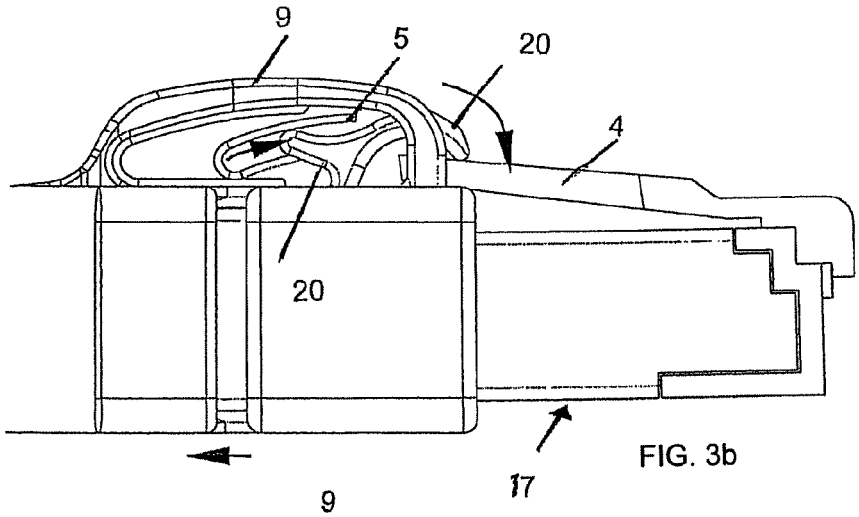
FIG. 3b
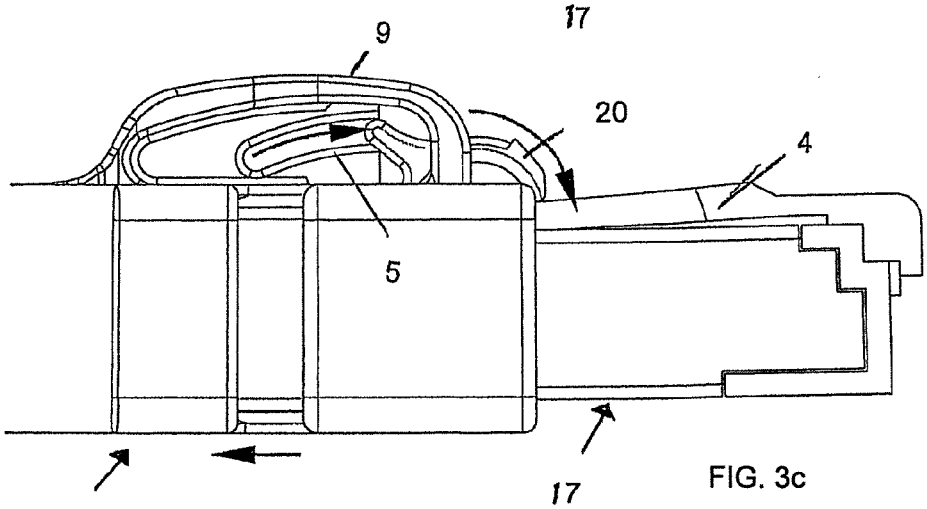
FIG. 3c
8
FIG. 3

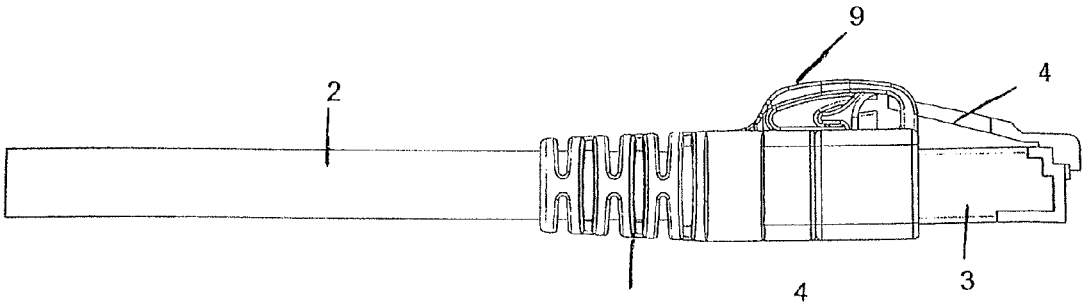
FIG. 4a
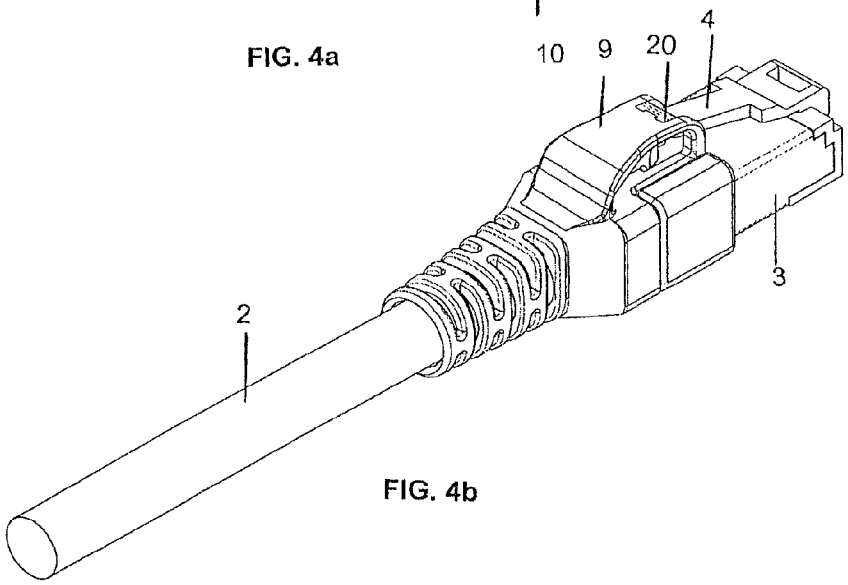
FIG. 4b
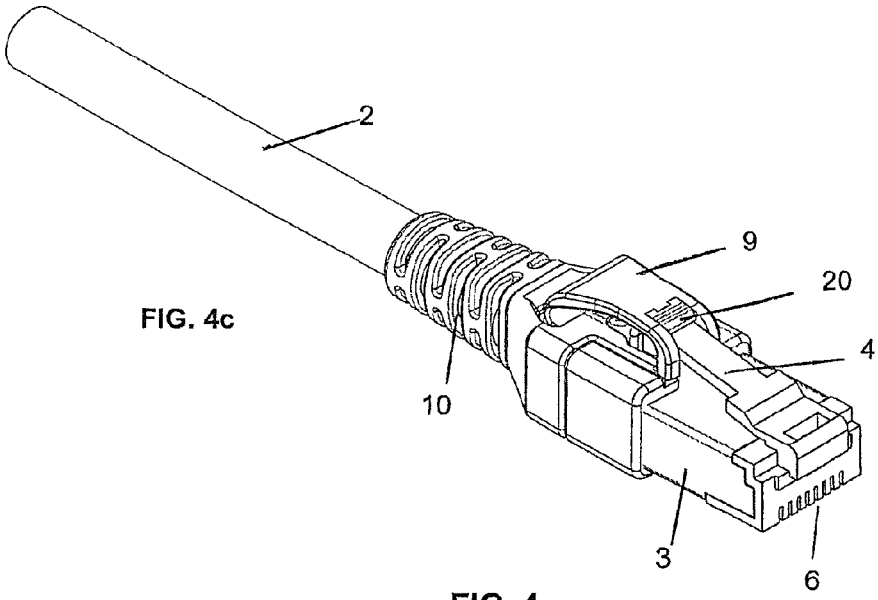
FIG. 4c
FIG. 4

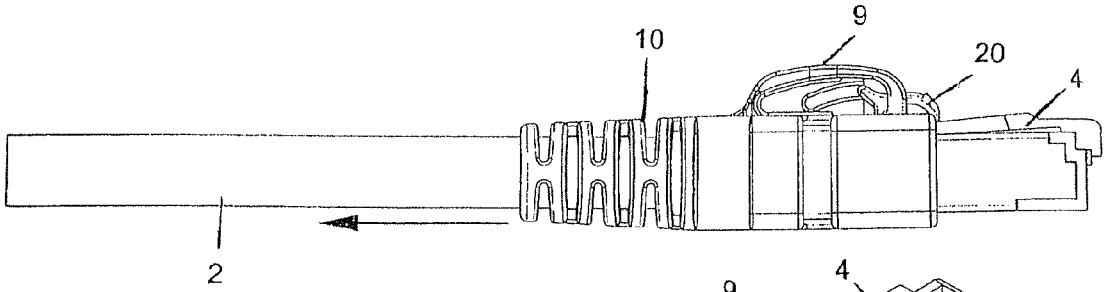
FIG. 5a
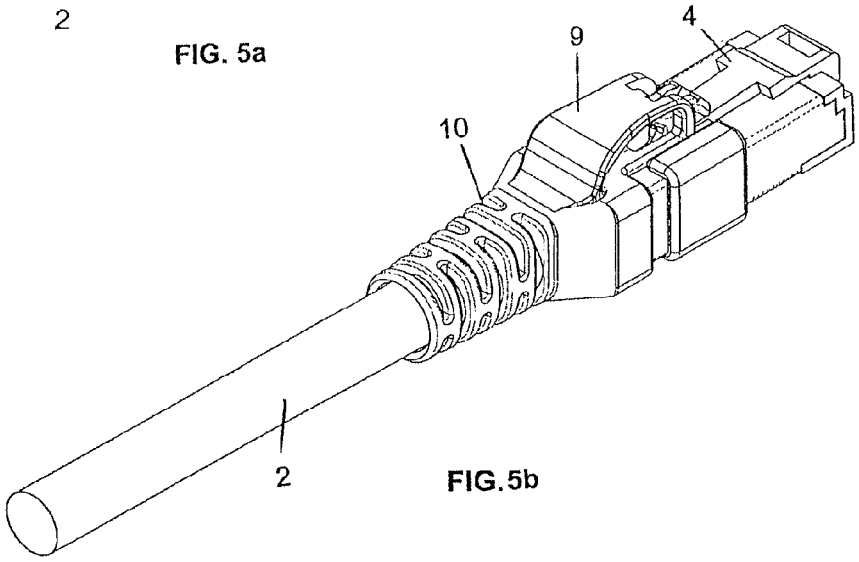
FIG.5b
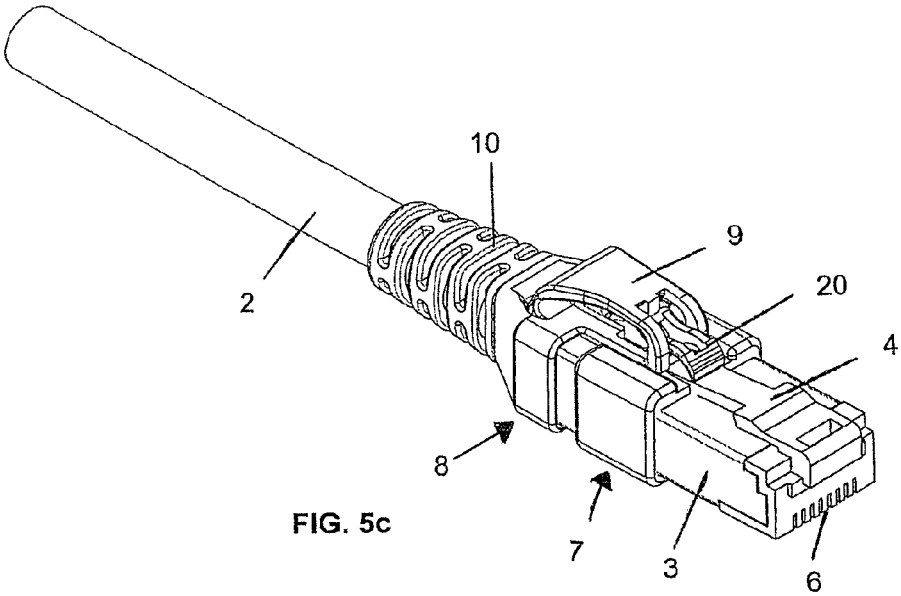
FIG. 5c
FIG.5

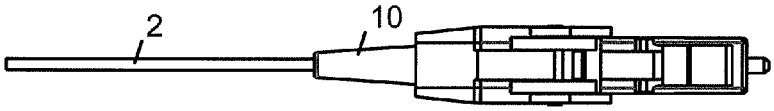
FIG. 6a
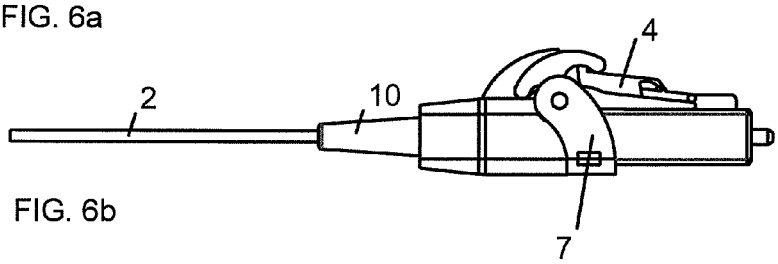
FIG. 6b
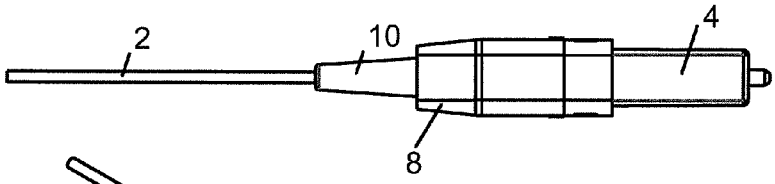
FIG. 6c
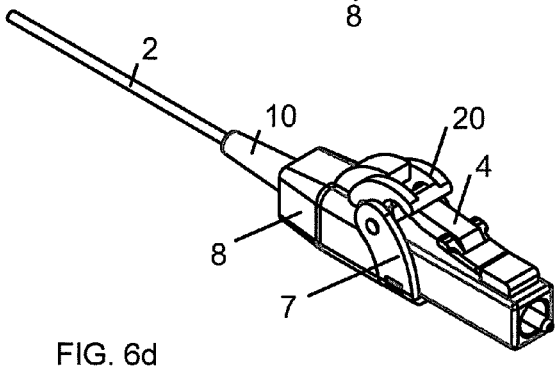
FIG. 6d
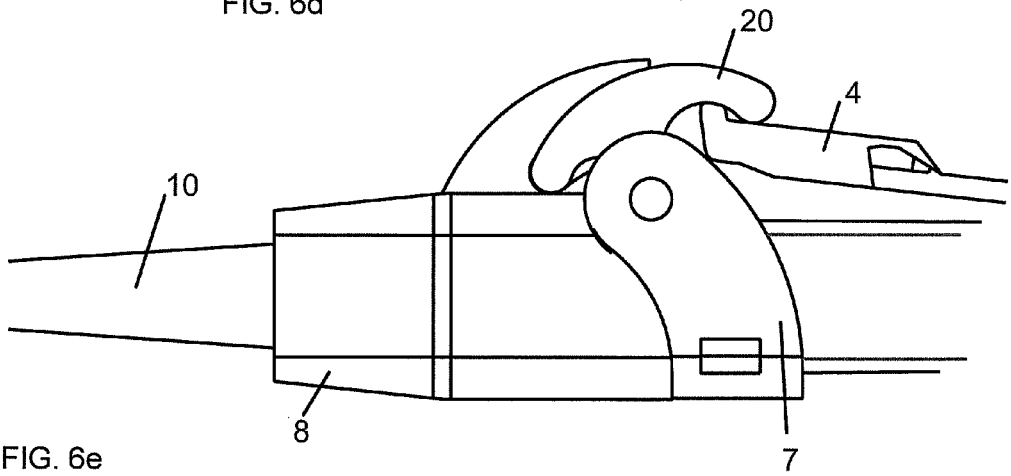
FIG. 6e
FIG. 6

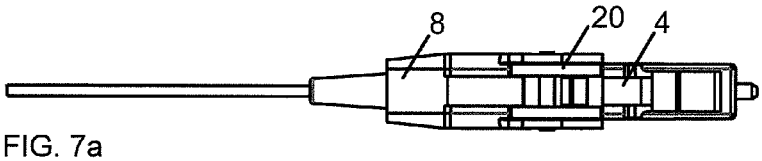
FIG. 7a
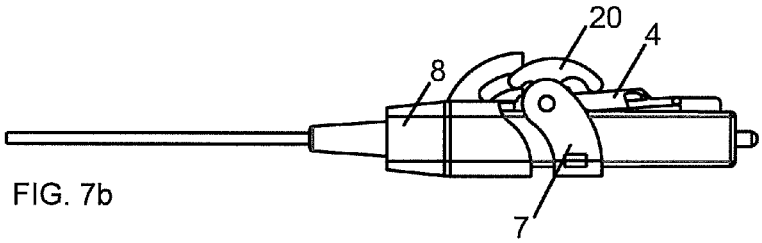
FIG. 7b
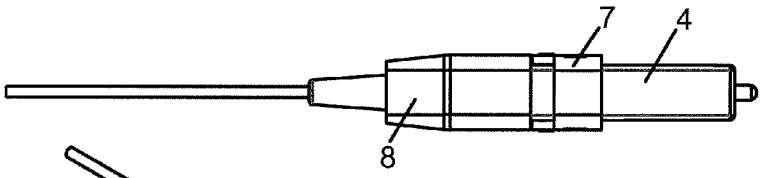
FIG. 7c
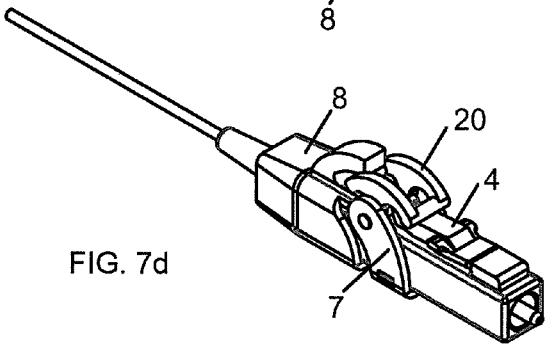
FIG. 7d
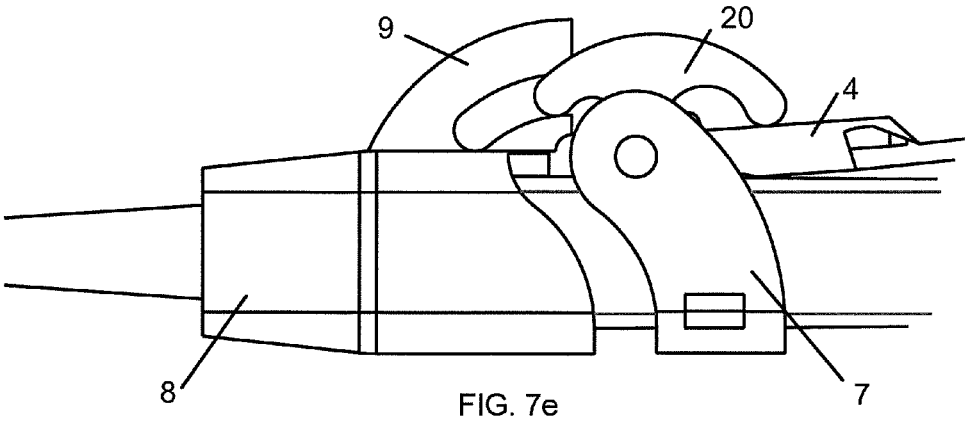
FIG. 7e
FIG. 7

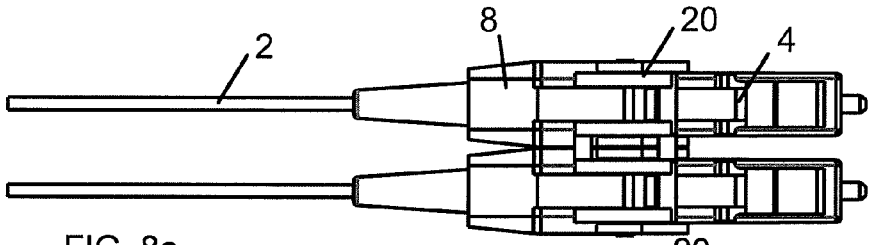
FIG. 8a
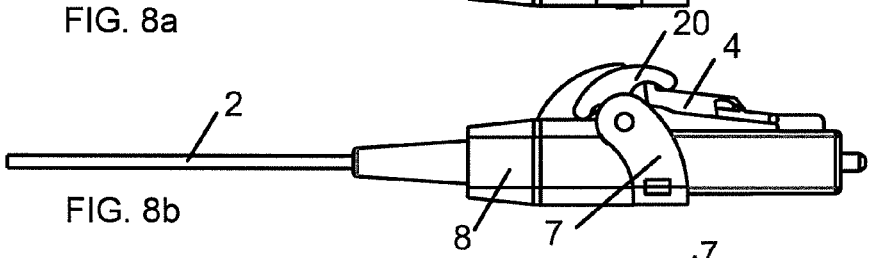
FIG. 8b
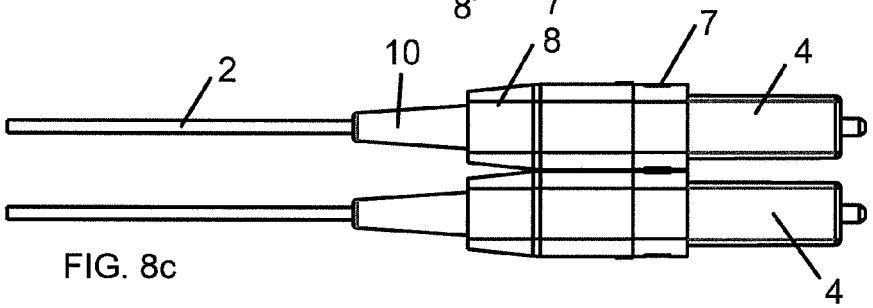
FIG. 8c
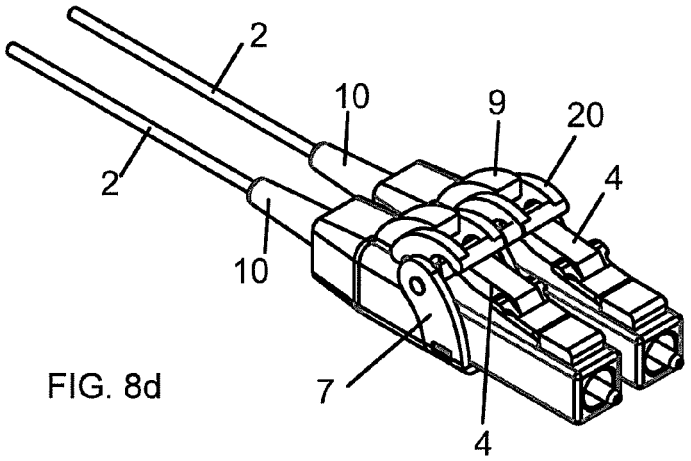
FIG. 8d
FIG. 8

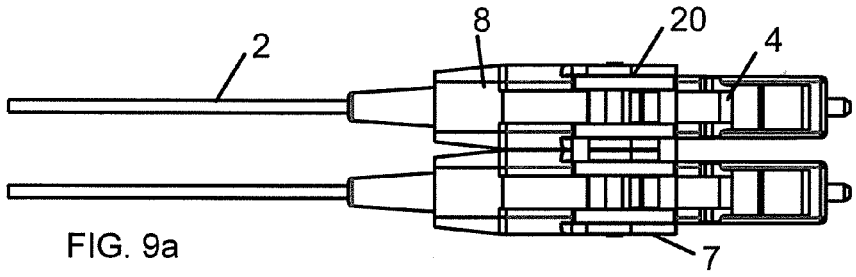
FIG. 9a
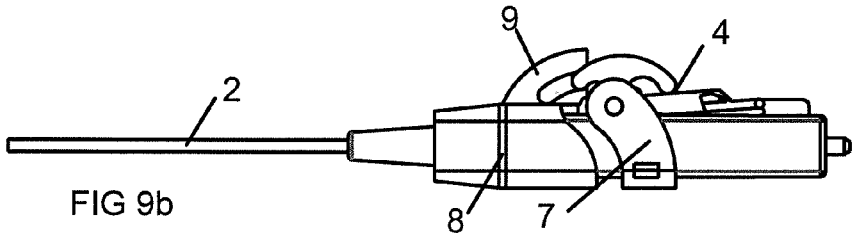
FIG 9b
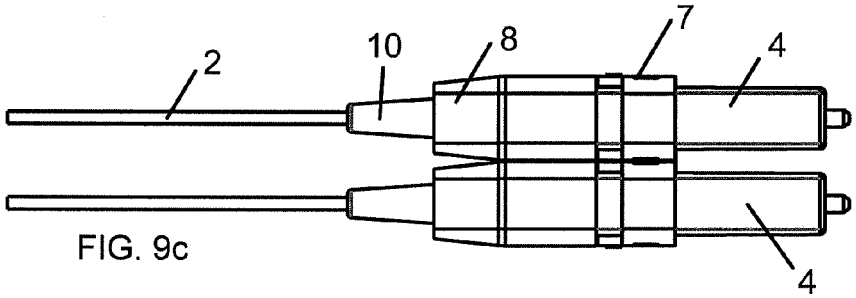
FIG. 9c
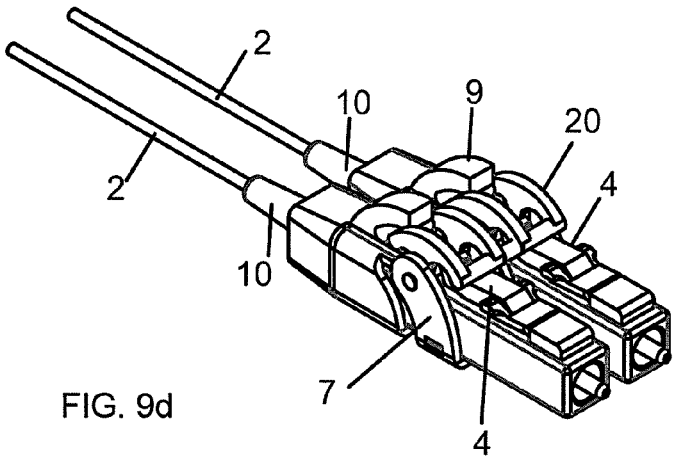
FIG. 9d
FIG. 9

FIG. 10a
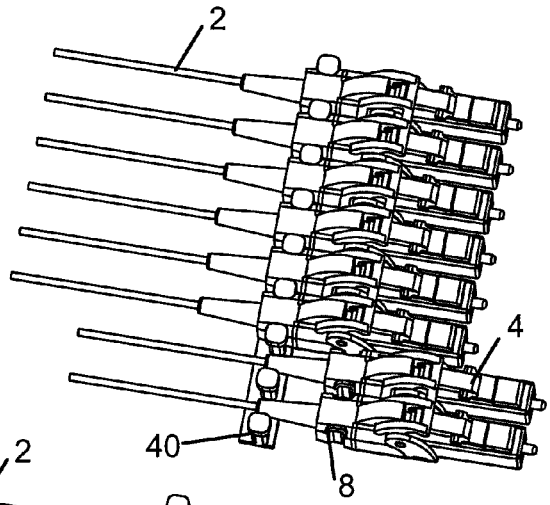
FIG. 10b
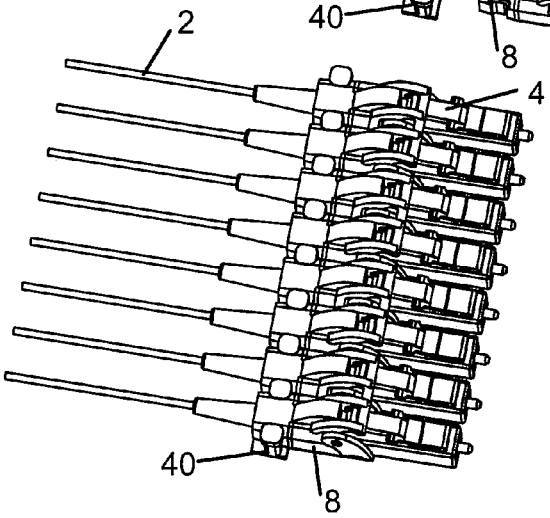
FIG. 10c
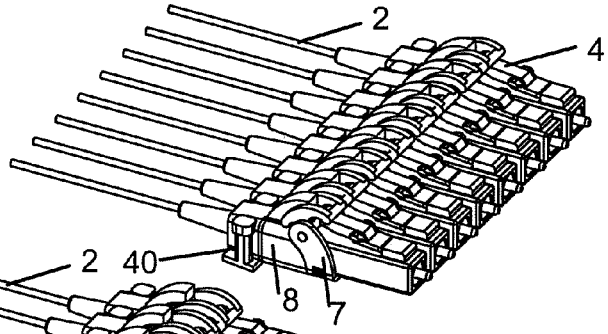
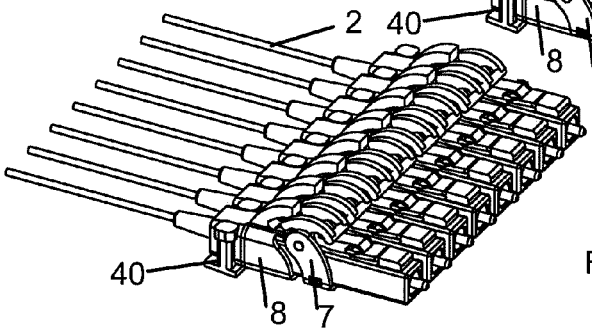
FIG. 10d
FIG. 10

PLUG FOR A DATA CABLE WITH PULLING PRESSURE RELEASE

BACKGROUND OF THE INVENTION

1. Field of the Invention

The invention relates to an unlatchable data cable plug with a latching tongue as well as to a method for quick and space-saving unlocking of a data cable plug having a latching tongue.

2. Description of Related Art

For securing plugs inside sockets, particularly for data cables, plug elements are commonly provided with a springy-elastic latching tongue, which in its front part has a snap-in locking device for engagement with a corresponding engagement device located inside a socket, so that when the latching tongue is released, the snap-in locking devices of socket and latching tongue are brought in mesh and secure the plug inside the socket, protecting it against pulling out. When the latching tongue is pushed down, the engagement is released, the interlock of plug and socket is opened and the plug can be pulled out. However, latching tongues have the disadvantage of being located in close proximity to the socket and in places difficult to access, so that pushing down the latching tongue and pulling out the plug takes some effort and time. Especially when the connection density is high, pulling out a single plug secured by a latching tongue is problematic and results in disproportionally high effort. What is more, latching tongues have been prone to showing mechanical weakness and could even break or get otherwise damaged, which leads to even bigger problems when it comes to separating the plug from the socket.

From the German Utility Model DE 20 2004 019 870 U1, a plug with a latching tongue for a data cable is known, in which, after assembly, the front section of the data cable as well as the front plug elements are encapsulated with plastic material, wherein this rear plastic material encapsulation comprises a forward-facing protective arm for the latching tongue of the front plug element. Such a protective arm also supports handling of the latching tongue. The disadvantage of such a plug with a rear plastic material encapsulation which is carrying a forward-facing protective arm for the latching tongue of the plug element is that, in practical use, the forward-facing latching tongue protective arm of the rear plastic material encapsulation often "creeps" below the backward-facing latching tongues of the front plug element. When this happens, it becomes either impossible to push down the latching tongue of the front plug element, or this is only possible to a limited extent or with some difficulty, thus making unlocking the plug either impossible or only possible with some effort.

Another plug with a latching tongue is known from U.S. Pat. No. 5,620,335 B1. It has a plug-on kink protection element for a data cable with a conventional strain relief as well as a latching tongue protection element with a plug-on kink protection element. This strain relief leaves some room for further improvement.

In U.S. Pat. No. 7,063,554 B2, a data plug with a modular design is described, in which a latching tongue protection element can be pushed on top of the plug. Here, too, a conventional cable strain relief is necessary, resulting in disadvantages with regard to robustness as well as in insufficiently stable transmission performance.

U.S. Pat. No. 5,462,457 B1 comprises an encapsulation with a cast-on kink protection element as well as an encapsulated snap-in nose protection element, wherein the snap-in nose protection element has to be elaborately inserted into the mold before the encapsulation is manufactured. This results in considerable production costs.

German Patent DE 199 53 494 C1 teaches a data cable plug with a one-piece encapsulation without any snap-in nose protection, making the snap-in nose of the plug prone to getting caught and being severed.

German Patent Application DE 10 2006 035 724 B4, a multi-piece plug for a data cable with a front plug element including a latching tongue, a front sub-body attached to the front end of the data cable by means of an encapsulation to achieve a high tensile strength; a rear sub-body in the form of a plug-on tubular body with a forward-facing latching tongue protection element and in the back a flexible kink protection element for the data cable; and a plug element protruding in forward direction from the front sub-body and having a backward-facing latching tongue has become known, wherein the front area of the latching tongue protection element at least partially projects from the top surface of the rear area of the latching tongue. This plug is easy to manufacture, but has the disadvantage that it can only be pulled out with some difficulty from sockets that are located at places difficult to access.

SUMMARY OF THE INVENTION

The object of the present invention is to provide a plug which comprises a conventional latching tongue as well as a latching tongue protection element for a front plug element latching tongue, wherein the plug is easy to handle in practical use and particularly is easy to unlock, as well as to provide a method for quick release of at least one plug with a latching tongue.

According to the invention, this object is achieved by using a generic multi-piece plug with the features described herein as well a method for the quick unlocking of plugs that are secured in sockets with the help of latching tongues.

Herein, a plug for a data cable according to the invention, such as an RJ45 plug, comprises a conventional front plug element with a latching tongue, where the wires of the data cable lead to the contacts of a plug element, comprising: a front sub-body including an encapsulation which is attached to the plug element at the front end of the data cable in a tension-resistant manner to provide a high tensile strength; a rear sub-body in the form of a plug-on tubular body with a forward-facing latching tongue protection element as well as a flexible kink protection element for the data cable; an angularly curved actuating lever at the front sub-body that has a rotation axle that is mounted in the encapsulation and that is pushing with one end of the lever arm onto the latching tongue and is guided with the other end of the lever arm inside an actuating lever guide of the latching tongue protection element, wherein, in the connected state of the plug, the actuation side of the actuating lever lies on the front area of the latching tongue protection element, and wherein, when the plug is being pulled out at an area of the rear sub-body, for example, the kink protection element, the actuating lever is actuated through the actuating lever guide, creating pressure on the latching tongue and at the same time releasing the lock connection in a socket, so that the data cable plug can be pulled out in an unlocked state.

The term "encapsulation" is meant to include any molded part that is attached to the front sub-body of the plug and encapsulates the same in a sleeve-like manner. It can also be a shaped part that is either plugged on in a form-fitted manner, glued on or welded on. The only relevant thing here is that it serves on a conventional plug as a bearing or a base for the actuating lever on the front sub-body. Accordingly, it is not necessary to modify the plugs, so that commercially available plugs with latching tongue can be used which then are push-pull-enabled with the "encapsulation" and the rear sub-body that is plugged on in a slideable manner on top of the cable before the plug is attached.

In this manner, the actuating lever is exerting pressure on the latching tongue, thus resulting in the release of the plug, for example, from a socket, as the latching tongue is unlocked, which is affected without the latching tongue being touched and solely through pulling at the anti-kink protection element or the rear sub-body of the cable.

This advantageous unlocking solution for the plug results in considerably simplified handling of the assembled cable even in the most narrow patch fields or at inaccessible cable conduit interfaces.

The rear sub-body of the plug can have at least one notch or recess, and its front sub-body can have at least one projection, that have respectively corresponding points for the purpose of engaging, clipping-in or inserting them into each other when the rear sub-body is slid onto the front sub-body until it has reached its final position.

However, the rear sub-body of the plug can also have one or more projections and its front sub-body can have one or more notches or recesses which have respectively corresponding points for the purpose of engaging, clipping-in or inserting them into each other when the rear sub-body is slid onto the front sub-body until it has reached its final position.

The rear sub-body of the plug can have one or more hole-like recesses in its side area and/or on its bottom side for engagement with at least one projection of the front sub-body, wherein the recess and the projection engage with each other or clip in or are inserted into each other at respectively corresponding points when the rear sub-body (8) is slid onto the front sub-body until it has reached its final position. The length of the hole-like recess restricts the removal of the rear sub-body 8 from the front sub-body 7 on the cable 2.

In contrast to all known push-pull plug variants, a standard plug without any modifications can be used with the invention. This means a significant price advantage. Many users can only use a designated type of plug and a specific plug manufacturer, and here, too, the invention can be used to its full extent, as no modifications are necessary on the plug. The invention describes a push-pull variant which is particularly space-saving thanks to its structure, so that it can also be used when packing densities are extremely high.

The overmolded front sub-body as well as the rear sub-body usually substantially consist of thermoplastic material. The kink protecting element, which is preferably envisaged as forming a one-piece part with the rear sub-body, can be made from the same material.

For example, the front sub-body can comprise a front section and an oppositely facing rear section; wherein the front section has a plug element and the rear section serves for receiving the data cable.

In one embodiment, the height and width of the rear section of the front sub-body can be smaller by at least the wall thickness of the rear sub-body, so as to ensure a stepless transition between the surface of the rear sub-body and the surface of the front section of the front sub-body. The protrusions that are provided at the front sub-body can be attached externally on the rear section of the front sub-body so that they can be connected to the rear sub-body.

The rear section of the front sub-body can be completely enclosed by the rear sub-body in its assembled, slid-on final state, also including window-like recesses.

The longitudinal axle of the latching tongue protection element of the rear sub-body is preferably aligned in parallel with the longitudinal axle of the plug in the lateral view and top view, wherein the latching tongue protection element has an actuating lever guide, which, when both sub-bodies are pushed together, pivots the actuating lever that is pivotably mounted in the encapsulation of the sub-body, so that the latching tongue latch is released, and pivots the angled pressure lever as the sub-bodies are being pulled apart, so that the latching tongue is pushed downwards.

Advantageously, plugs according to the invention can be operated at the same time when the grip areas are accommodated in a holding device for several plugs, so that the latching tongue of the plug is released when the holding device is pulled in the direction of the cable.

The method for unlocking of at least one plug according to one of the preceding claims comprises providing a grip area in the area of the cable connection at the rear sub-body; wherein through pulling at the grip area of the moveable rear sub-body with the simultaneous removal of the rear sub-body from the front sub-body on the plug casing until an edge of a recess of the rear sub-body hits against a limitation/protrusion of the front sub-body guided therein and restricts the removing motion of the rear sub-body from the front sub-body; an actuation of the actuating lever for the purpose of pushing down the latching tongue via the actuating lever guide inside the latching tongue protection element is effected and the plug connection is released.

The invention can be used with copper and fiber optic plug, i.e., it is not restricted to any specific type of plug. The plugs only need to comprise a latching tongue.

Examples of the embodiments of the invention, which are not limiting the same in any way, are described in more detail in the following by referring to the drawings.

BRIEF DESCRIPTION OF THE DRAWINGS

FIGS. 1*a*-1*d* show perspective exploded diagrams of the plug according to the invention during assembly in a side view, in a view as seen from the direction of the data cable, in perspective view and also with a detail of the actuating lever and the encapsulation 30;

FIG. 2*a*-2*d* show perspective drawings of the two plug parts to be pushed together in their assembled state in a side view, in a perspective view as seen from the direction of the data cable, as a detail of the actuating lever inserted into the encapsulation, and in perspective view as seen from the direction of the sub-body;

FIGS. 3*a*-3*c* show a longitudinal section through the assembled multi-piece plug, wherein FIG. 3*a* depicts the plugged-together plug, FIG. 3*b* shows the plug as pulling occurs, and FIG. 3*c* represents the plug in the state of being completely pulled out at the kink protection element encapsulation, with the latching tongue being pushed down;

FIGS. 4*a*-4*c* show the assembled plug in a side view, in a perspective view as seen from the direction of the cable, as well as in a perspective view as seen from the front; and FIG. 5*a*-5*c* show the plug in its pushed-together state in a side view, in a perspective view as seen from the direction of the cable, as well as in a perspective view as seen from the front.

FIG. 6*a*-6*e* show a single plug in a locked state from top, side, bottom and enlarged side views;

FIG. 7*a*-7*e* shows the single plug from FIG. 6 in an unlocked state from top, side, bottom and enlarged side views;

FIG. 8*a*-8*d* show two locked plugs arranged next to each other from top, side, bottom and perspective views;

FIG. 9*a*-9*d* shows the two plugs from FIG. 8 in an unlocked state top, side, bottom and perspective views; and FIG. 10*a*-10*d* shows multiple plugs inside a holding device for simultaneous operation.

DETAILED DESCRIPTION OF THE INVENTION

Plugs equipped according to the invention can be used with data cables.

As apparent particularly from FIG. 1*d*, the multi-piece plug according to the invention comprises a standard front plug element 6 as well as a latching tongue 4 meant for being operated in connection with a socket or a cable connector.

The plug according to the invention comprises an overmolded front sub-body 7 and a separate rear sub-body 8 in the form of a pushed-on tubular body with a protection element for the latching tongue 9 that can be plugged onto the front sub-body 7.

Normally, the front sub-body 7 is attached to the front end of the data cable 2, for example, by means of an encapsulation of the data cable 2, for the purpose of maintaining high tensile strength. In contrast to the front sub-body 7, the rear sub-body 8 is embodied as a plug-on tubular body with a latching tongue protection element that is slidable along the data cable in a state in which it is not coupled to the front sub-body 7 (see, FIG. 1).

As can be seen in the figures, the rear sub-body 8 can be completely or at least partially engaged with the front sub-body 7 in a force-fitted and/or form-fitted, reversible or irreversible manner.

As shown in FIG. 2, the rear sub-body 8 normally has a forward-facing latching tongue protection element 9 for the backwards-facing latching tongue 4 of the front sub-body 7 with the plug element.

As can be seen from FIGS. 2 and 3, the front area of the latching tongue protection element 9 is usually completely or partially protruding above the top side of the rear area of the latching tongue 4.

To ensure safe guidance of the actuating lever by means of the actuating guide 5 within the latching tongue protection element 9, the material chosen for the rear sub-body 8 including the latching tongue protection element will preferably be a relatively hard one, with the modulus of elasticity falling in the range of, for example, 1.0 kiloNewton/mm$^2$ to 4.0 kiloNewton/mm$^2$, preferably, in the range of 2.0 kiloNewton/mm$^2$ to 3.9 kiloNewton/mm$^2$, and more particularly in the range of 3.0 kiloNewton/mm$^2$ to 3.8 kiloNewton/mm$^2$.

As can be seen in the FIGS. 1*d*, 2*c* and 2*d*, the rear sub-body 8 may comprise one or more recesses 11 or indentations, and as shown in FIG. 1*a*, the front sub-body 7 may comprise one or more projections 12.

Usually, the recesses 11 and projections 12 are located at points corresponding to each other for the purpose of engaging, clipping-in or inserting them into each other, when the rear sub-body 8 is slid onto the front sub-body 7 until it has reached its final position.

In particularly preferred embodiments of the plug according to the invention, the rear sub-body 8 can have one or more projections 12, and the front sub-body 7 can have one or more notches or recesses 11, wherein these projections 12 and notches or recesses 11 are located at points corresponding to each other, which is envisaged for the purpose of engaging, clipping-in or inserting them into each other as the rear sub-body 8 is slid onto the front sub-body 7 until it has reached its final position.

The overmoulded front sub-body 7 can be manufactured substantially from a thermoplastic, preferably from an elastic thermoplastic, for example.

Usually, the front sub-body 7 is a little softer and more flexible than the rear sub-body 8, so that the modulus of elasticity of the front sub-body 7 can fall into the range of, for example, 0.5 kiloNewton/mm$^2$ to 3.0 kiloNewton/mm$^2$, and preferably into the range of 0.6 kiloNewton/mm$^2$ to 2.5 kiloNewton/mm$^2$, particularly into the range of 0.7 kiloNewton/mm$^2$ to 2.0 kiloNewton/mm$^2$.

The rear sub-body 8 can substantially be formed of Duroplast® (a resin plastic reinforced with fibers) or a thermoplastic, for example.

Alternatively, the rear sub-body 8 can be at least a little harder than the softer and more flexible front sub-body 7, with the modulus of elasticity of the rear sub-body falling into the range of, for example, 2.5 kiloNewton/mm$^2$ to 4.0 kiloNewton/mm$^2$, and preferably into the range of 2.8 kiloNewton/mm$^2$ to 3.9 kiloNewton/mm$^2$, particularly into the range of 3.0 kiloNewton/mm$^2$ to 3.8 kiloNewton/mm$^2$.

A kink protection element 10 is provided at the rear sub-body 8, and preferably, forms a one-piece part therewith and preferably can be made from a material the same materials described above for the rear sub-body. The overmoulded front sub-body 7 can have a front section 17 and a rear section 18, wherein the front section 17 comprises a plug element and the rear section 18 serves for receiving the data cable 2.

As can be seen in FIGS. 1*a*, 2*a*, 2*b* and 3, the front section 17 of the overmoulded front sub-body 7 comprises an actuating lever 20 that is supported within the encapsulation 30 and serves for pushing down the latching tongue 4 of the plug element.

FIG. 3 shows in longitudinal section how the actuating lever 20 acts upon the latching tongue 9 of the plug element.

FIGS. 4*a*-4*c* show the plug 1 in different views in a plugged-in state. It can be clearly seen that the actuating lever 20 is only resting on the latching tongue 4 in the plugged-in state.

FIG. 5 shows the plug 1 in different views in the pulled-out state. It can be clearly seen that the actuating lever 20 is pushing down on the latching tongue 4 in the pulled-out state.

As particularly becomes apparent in FIG. 1*a*, the projections 11 provided at the overmoulded front sub-body 7 for the purpose of enabling a force-fitted and/or form-fitted connection with the rear sub-body 8 that is embodied in the form of a plug-on tubular body 10 are attached preferably externally on the rear section 18 of the encapsulated front sub-body 7.

FIGS. 6 and 7 show another type of plug, which is smaller and therefore can be attached in patch-panels having a higher density. Particularly, from FIGS. 8 and 9, it becomes apparent how two of these plugs can be arranged lying close to each other. Without the push-pull device, it is hard to impossible to pull out individual plugs. Thanks to the push-pull device, a single plug can be easily unlocked or locked by pulling at the rear sub-body or the kink protection element without also having to pull out or plug in the neighboring plugs. The advantageousness of the push-pull solution is evident.

In FIG. 10, a row combination of plugs according to the invention with a holding device 40 is shown, which collectively fix the rear sub-bodies 8. The holding device has at least one row of upstanding pins spaced at a distance and in a manner for releasable holding a respective one of a plurality of plugs between each of two consecutive pins. By using such a holding device 40 several sub-bodies 8 connected by means of the same holding device can be removed together from the front sub-body 7, and thus, the plugs can be unlocked at the same time. Thus, a "multiple plug effect" is achieved, which particularly in highly occupied patch fields can be used advantageously. Here, the holding device 40 is by no means limited to the shown row-configuration; other holding devices are also possible as long as they lead to a concerted motion of the rear sub-bodies 8. Thus, plug arrangements of a square or rectangular shape with plugs arranged on top of each other are possible that can be unlocked at the same time.

The figures show that the longitudinal axle of the latching tongue protection element 9 of the rear sub-body 8 that is embodied in the form of a slip-on tube is aligned in parallel to the longitudinal axis of the plug 1.

Also, it becomes apparent from the figures, that the kink protection element 10 that forms a one-piece part with the rear sub-body 8 takes the form of a flexible sleeve in the shape of a pipe or a tube having multiple slit-shaped recesses that are arranged in an offset pattern in relation to each other for the purpose of providing flexibility.

In summary, it can be said that, within the scope of the present invention, a plug is provided which comprises a rear latching tongue protection element as well as an actuating lever for the front latching tongue 4 located at the plug element side, wherein, as far as the rear latching tongue protection element is concerned, it can be ensured by selecting a suitable modulus of elasticity for the material of the rear sub-body 8 and the latching tongue protection element 9 attached thereto that, even under the rough conditions of practical use, the actuating lever 20 can be actuated by the latching tongue protection element 9.

This particularly advantageous feature of the plug according to the invention, i.e., being able to unlock the rear sub-body by simply pulling at it, is achieved particularly through the comparatively hard embodiment of the latching tongue protection element 9 including the actuating lever guide 5 of the rear sub-body 8.

A further advantage of the plug according to the invention is that, thanks to the plastic encapsulation of the front plug element—thus making it possible to avoid the otherwise feared mechanical squeezing of the data cable—a particularly effective and safe strain relief is achieved. In addition, the plastic encapsulation of the front plug element provides a particularly high level of stability in the plug according to the invention.

As the externally visible color of the plug according to the invention 1 is substantially determined by the color of the rear sub-body that is embodied in the shape of a slip-on tube, the front plastic encapsulation of the front sub-body can always be embodied in one and the same color, for example, in black, irrespective of the different external colors of the complete plug.

Therefore, the time-consuming, tedious and costly refitting of the plug molding machine during manufacture of the plug as well as the interruption of the plug manufacturing process warranted by the change of the external color is not necessary with the plug according to the invention. Rather, the change of the plug color can be performed in a particularly easy, quick, effortless and cost-effective manner with the plug according to the invention by using a correspondingly colored rear sub-body which is formed in the shape of a slip-on tube. Color variants of the plug according to the invention are thus preferably realized by using rear sub-bodies 8 of different colors that are formed in the shape of a slip-on tube.

Moreover, a particular advantage of the plug according to the invention consists in the fact that customer logos, customer-specific labeling or other kinds of marks can be added effortlessly, quickly and easily on the inside or the top of the front encapsulation of the front plug element, for example, by printing on or stamping inside the mold. Also, based on the modular system of the plug 1 according to the invention, a customer-specific sub-body 8 formed in the shape of an slip-on tube can be used, including an OEM design where required and having one or more recesses in the form of fields for customer-specific labeling, through which the markings which are envisaged at the exterior of the front encapsulation of the front plug element as described above are discernible visually and/or haptically.

Although the invention has been described by referring to preferred exemplary embodiments, it will be apparent to a person of ordinary skill in the art that they are in no way limited to the described embodiments, but are meant to include the range of use as it is familiar to a person skilled in the art within the scope of the appended claims.

What is claimed is:

1. Plug for a data cable, comprising:

a front sub-body with a latching tongue and having an encapsulation attached in a tension-resistant manner at a front end of a data cable, a plug-in element with electrical contacts, a rear sub-body with a latching tongue protection element for the latching tongue that faces towards a front end of the plug, has an actuating lever guide and a flexible kink protection element for the data cable;

an angularly curved actuating lever that is located at the front sub-body and has a rotation axis that is mounted in the encapsulation and that pushes one end of the lever onto the latching tongue and is guided at an opposite end of the lever inside the actuating lever guide of the latching tongue protection element, wherein, in a connected state of the plug, an actuation side of the actuating lever lies on a front area of the latching tongue protection element, and wherein, when the plug is pulled out at an area of the rear sub-body, the rear sub-body is pulled apart in a manner causing the actuating lever to be actuated by the actuating lever guide and creating pressure on the latching tongue so that a lock connection is released, and the plug can be pulled out in an unlocked state.

2. according to claim 1, wherein the rear sub-body has at least one notch or recess and the front sub-body has at least one projection which is engageable in the at least one notch or recess when the rear sub-body is slid onto the front sub-body and reaches a final position.

3. Plug according to claim 1, wherein the rear sub-body comprises at least one protrusion and the front sub-body has at least one recess or indentation, the at least one protrusion being at least engageable in the at least recess or indentation when the rear sub-body is slid onto the front sub-body until and reaches a final position.

4. Plug according to claim 1, wherein the rear sub-body has one or more recesses for engagement with at least one protrusion on at least one of a top and a bottom side of the front sub-body, wherein the recess and the protrusion engage with each other when the rear sub-body is slid onto the front sub-body and has reached a final position.

5. Plug according to claim 1, wherein the front sub-body has a front section and a facing rear section, and wherein, in use, the front section receives a plug-in element and the rear section receives a data cable.

6. Plug according to claim 5, wherein the front section of the front sub-body has a recess for pushing down the latching tongue in a pivoting range of the latching tongue.

7. Plug according to claim 5, wherein the rear section of the front sub-body has a height and width that are smaller than the rear sub-body by at least a wall thickness of the rear sub-body so as to ensure a stepless transition between a surface of the rear sub-body and a facing surface of the front section of the front sub-body.

8. Plug according to claim 5, wherein the rear sub-body has one or more recesses for engagement with at least one protrusion on at least one of a top and a bottom side of the front sub-body, wherein the recess and the protrusion engage with each other when the rear sub-body is slid onto the front sub-body and has reached a final position, and wherein the at least one protrusion provided at the front sub-body is located externally on the rear section of the front sub-body for the connection with the rear sub-body.

9. Plug according to claim 1, wherein the rear section of the front sub-body is enclosed by the rear sub-body in its assembled and connected state.

10. Plug according to claim 1, wherein at least a portion of the kink protection of the rear sub-body that, in use, is out of contact with a date cable received therein, is formed as a flexible elastic sleeve with recesses.

11. Method for unlocking at least one plug having a front sub-body with a latching tongue, and a plug-in element with electrical contacts and a movable rear sub-body with a latching tongue protection element for the latching tongue that faces towards a front end of the plug, has an actuating lever guide and a flexible kink protection element for the data cable, wherein a grip area is provided in a cable connection area of the rear sub-body; comprising the steps of:

pulling at the grip area of the moveable rear sub-body effecting a concerted removal of the rear sub-body from the front sub-body on a plug casing until an edge of a recess of the rear sub-body hits against a limitation protrusion of the front sub-body thereby restricting the removing motion of the rear sub-body from the front sub-body; and actuating an actuation lever of the front sub-body so as to push down the latching tongue via the actuating lever guide inside the latching tongue protection element so as to release a plug latch.

12. Plug holding device having at least one row of upstanding pins spaced at a distance and in a manner for releasable holding a respective one of a plurality of plugs between each two pins, each plug comprising:

a front sub-body with a latching tongue and an encapsulation attached at a front end of a data cable in a tension-resistant manner, a plug-in element with electrical contacts, a rear sub-body with a latching tongue protection element for the latching tongue that faces towards a front end of the plug, has an actuating lever guide and a flexible kink protection element for the data cable;

an angularly curved actuating lever that is located at the front sub-body and has a rotation axis that is mounted in the encapsulation and that pushes one end of the lever onto the latching tongue and is guided at an opposite end of the lever inside the actuating lever guide of the latching tongue protection element, and a grip area in a cable connection area of the rear sub-body, wherein, in a connected state of the plug, an actuation side of the actuating lever lies on a front area of the latching tongue protection element, and wherein, when the plug is pulled out at an area of the rear sub-body, the sub-bodies are pulled apart in a manner causing the actuating lever to be actuated by the actuating lever guide and creating pressure on the latching tongue so that a lock connection is released, and the plug can be pulled out in an unlocked state, wherein the grip area is held by the upstanding pins in a manner such that, when the grip area is pulled, the latching tongue of the plug is released.

* * * * *